United States Patent [19]

Ponchaux

[11] 4,144,799

[45] Mar. 20, 1979

[54] FLUID MACHINE

[76] Inventor: Jean-Luc Ponchaux, La Cure de Petosse, 85570 L'Hermenault (Vendee), France

[21] Appl. No.: 809,914

[22] Filed: Jun. 24, 1977

[30] Foreign Application Priority Data

Jun. 25, 1976 [FR] France ..... 76 19341
Jul. 9, 1976 [CA] Canada ..... 256691

[51] Int. Cl.[2] ..... I01B 13/00
[52] U.S. Cl. ..... 91/488; 91/491
[58] Field of Search ..... 91/472–498; 417/273

[56] References Cited

U.S. PATENT DOCUMENTS

| | | | |
|---|---|---|---|
| 883,430 | 3/1908 | Smith et al. | 91/495 |
| 3,043,233 | 7/1962 | Rumsey | 91/485 |
| 3,056,357 | 10/1962 | Bohnhoff | 91/475 |
| 3,695,146 | 10/1972 | Orshansky | 91/481 |
| 3,777,624 | 12/1973 | Dixon | 91/488 |
| 4,018,139 | 4/1977 | Landreau | 91/490 |

FOREIGN PATENT DOCUMENTS

| | | | |
|---|---|---|---|
| 2023572 | 11/1971 | Fed. Rep. of Germany | 91/491 |
| 2425050 | 12/1974 | Fed. Rep. of Germany | 91/491 |
| 2323031 | 1/1977 | France | 91/491 |

*Primary Examiner*—William L. Freeh
*Attorney, Agent, or Firm*—Arthur Schwartz

[57] ABSTRACT

The hydraulic motor has a shaft rotatably mounted in a housing and mounting an eccentric to which is journaled an annular ring. A plurality of radial pistons are adapted for sliding movement within spherical members having cylindrical bores for receiving the radial pistons. Each of the spherical members is adapted for oscillating movement between an annular abutment and a spring-mounted annular ring-type valve seat.

The ring acts as a distributor sleeve or and as a conduit for fluid passing to and from the cylinders and a planar distributor.

The hydraulic motor can be used either as a pump or a motor at low or high speeds and under high pressures and is reversible.

9 Claims, 13 Drawing Figures

FLUID MACHINE

BACKGROUND OF THE INVENTION

1. Field of the Invention

The present invention relates to a rotary machine, and more particularly, to a radial piston machine using fluid under pressure.

2. Description of the Prior Art

There are a number of examples of this type of machine which illustrate different constructions having cylinders, connecting means between the pistons and an eccentric, and the system for distributing the fluid to the piston and cylinder.

There are certain disadvantages which have been found in present day hydraulic machines. For instance, such machines in which the cylinders are fixed in the housing can, generally speaking, transmit only modest powers because of the inefficient kinematic design thereof, and such machines have been subject to uneven wear as well as rapid wear of certain parts, as well as jamming of the pistons in such cylinders.

More technically evolved machines normally use oscillating cylinders. However, in such constructions, it has been noticed that due to the pressures applied on the cylinders while the machine is functioning, loads are normally insufficiently compensated, and it has been found in such oscillation that the mechanical friction present generates heat and wear which deteriorates the output of the machine, thus compromising the lifespan of the material and also limiting the transmittable power. Those solutions which have been provided which are theoretically satisfactory are really quite complex to manufacture and keep the manufacturing costs quite high, thus limiting the scope of the utility of such a machine and causing designers to simplify the design by compromising the performance and wear life of the machine. Furthermore, it has been found that the distributor means associated with the machines have always been insufficient from the point of view of sealing, stability and longer life.

The known fluid distributor systems which include a central cylindrical distributor with a rotating shaft generally have a cylindrical interface provided upstream of the distributor and include mechanical joints which are subject to pressure, velocity and friction, causing serious heating problems resulting in rapid deterioration of the system. The machine, therefore, rapidly loses its efficiency because of internal leakage. It is sometimes the practice, in order to overcome the problem of rapid wear, to use segmented metallic ring instead of the resilient seal, and because of this, the machine, therefore, has a lower volumetric efficiency. As far as present rotating planar distributors are concerned, they are in principle subject to asymmetric forces which interfere with the functioning of the machine, limiting the performance thereof and provoking asymmetric wear and generating leaks and, therefore, lower output. It has been possible to equilibrate these rotating planar distributors only by a complex number of parts, increasing, therefore, the costs.

Some of the patents which fall in this category and of which I am aware are French Pat. Nos. 990,840, published September 1951; 1,530,605, published May 20, 1968; 442,773, published September 1912; 928,968, published December 1947, 405,171, published December 1909; and French Patent of Addition 72,799 to French Patent 1,183,262, published April 1960. Also, I am aware of French Application No. 2,281,509, laid open to the public in March 1976. West German Offenlegungsschrifts 1,653,633, laid open September 1971, and 2,023,572, laid open November 1971, fall in this prior art. British Patent 650,810, published March 1951; U.S. Pat. Nos. 2,312,057, February 1943; 3,695,146, October 1972; 3,056,357, October 1962; and 2,166,909, July 1939; were also considered by me. Finally, the closest document found was German Offenlegungsschrift 2,244,920, laid open Apr. 4, 1974. None of these patents or published applications show the advantages of the present invention.

SUMMARY OF THE INVENTION

It is an aim of the present invention to provide a simple machine which eliminates many of the abovementioned disadvantages.

More precisely, it is an aim of the present invention to provide a machine operating with fluid under pressure, comprising a housing, a plurality of piston and cylinder arrangements disposed radially about an eccentric, the eccentric being integral with a rotating shaft rotating relative to the housing, the cylinders being retained in the housing but being subject to an oscillating principal movement in conjunction with the rotation of the shaft, and means are provided for maintaining the pistons in contact with the outer surface of the eccentric.

The distributor system for the fluid associated with the machine can be of any known construction. It can be cylindrical, planar, spherical, and either collective relative to the total number of cylinders, or it can individually feed each cylinder.

A construction in accordance with the present invention comprises a hydraulic machine having a plurality of radially extending pistons in a housing and a shaft mounting an eccentric in the housing, with means connecting the pistons radially with the eccentric. Each piston is mounted for sliding movement within a mobile cylinder, with the cylinder having a spherical outer surface and being retained between a pair of retaining rings. The first retaining ring has a concave spherical surface matching with the spherical surface of the outer surface of the cylinder. The first ring is mounted in the housing and functions as a hydrostatic pad for the cylinder. The second retaining ring, which is hydrostatically balanced, limits the field of pressure which is established above the cylinder. Spring means urge the second ring in contact against the spherical surface of the cylinder, with the cylinder thus having an oscillating movement subject to the rotation of the shaft relative to the housing. The cylinder is in hydrostatic equilibrium at all positions of its oscillation between the first and second retaining ring, and the cylinders are placed in communication successively with feed conduits and exhaust conduits provided in the eccentric.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
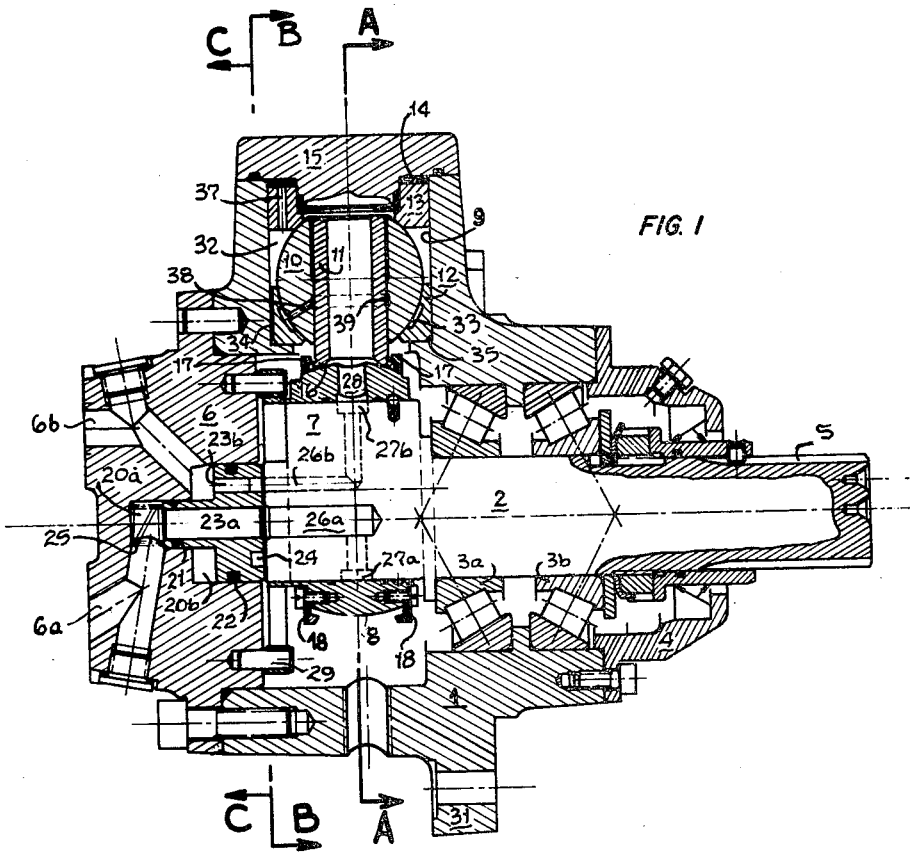
FIG. 1 is an axial section taken through a typical hydraulic machine in accordance with the present invention.

The embodiment shown in FIGS. 1 to 4 includes a hydraulic motor of the type having a rotating shaft and comprising a housing 1, a shaft 2 mounted for rotation on bearings 3*a* and 3*b* in the housing 1. The housing 1 is closed at one end by a cover 4 having an aperture allowing the end 5 of the shaft 2 to protrude. The other axial end of the housing is closed by a cover 6 which includes an inlet port 6*a* and an outlet port 6*b*. The shaft 2 is cantilevered by the bearings 3*a* and 3*b* and includes a cylindrical eccentric portion 7. An annular ring 8, which includes a cylindrical bore, fits on the cylindrical eccentric and is concentric therewith. The outer surface of the ring has a spherical shape.

Figure 2:
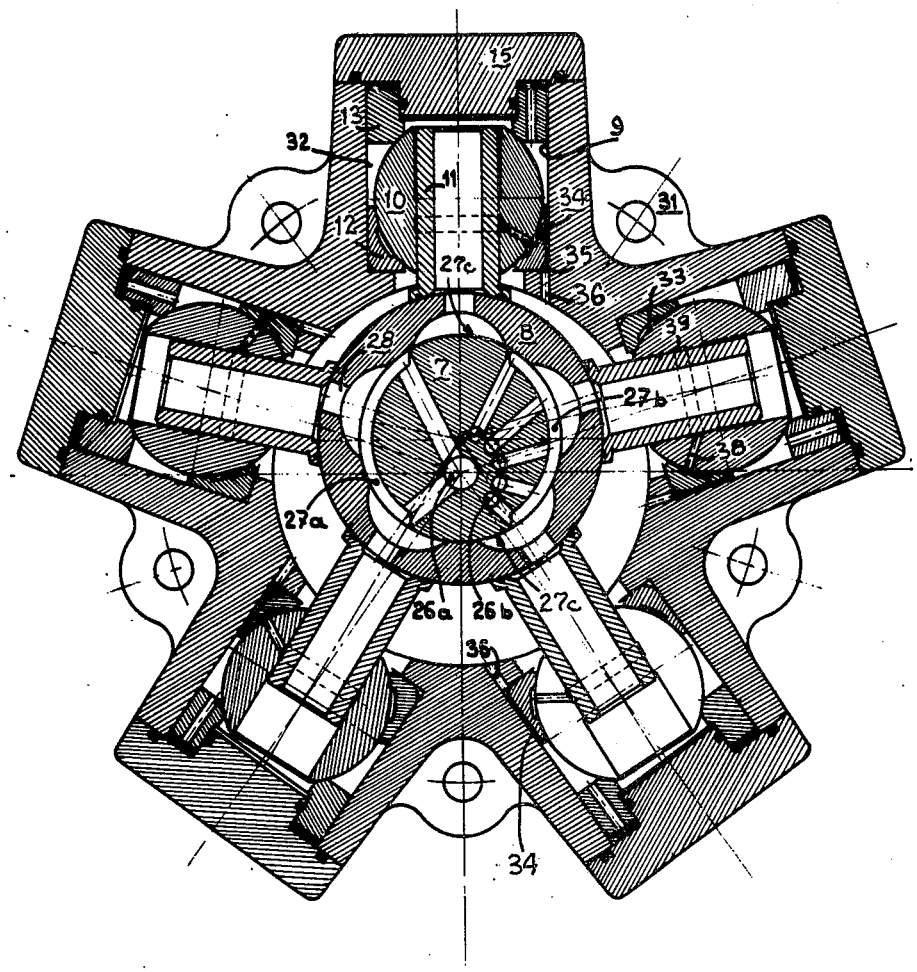
FIG. 2 is a radial cross-section taken along the line A—A of FIG. 1.
Figure 4:
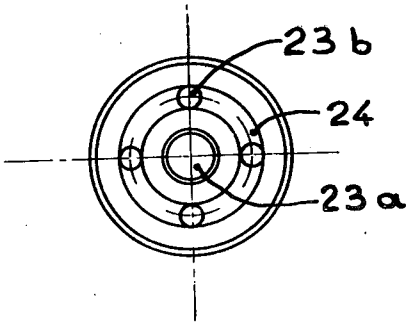
FIG. 4 is a further fragmentary, schematic cross-section taken along the line C—C of FIG. 1.

The housing 1 has a number of radially extending bores 9 at right angles to the shaft 2. As shown in FIG. 2, the present embodiment includes five such bores or cavities.

In each of the cavities 9, there is an arrangement of parts including a cylinder 10 having a spherical exterior surface and a cylindrical central bore which is adapted to receive in sliding relation a tubular piston 11. An abutment 12 in the form of a ring having a spherical concave segment forms a seat for the spherical cylinder 10. An annular ring 13 is held and abuts against the diametrically opposed area of the spherical cylinder 10 and is held by a ring-type spring 14.

The spring 14 is held against the retaining ring 13 by means of a removable cover 15 which closes the cavity 9 and is fixed thereto.

Each piston 11 includes a base part having a shoe 16 defined with a concave undersurface of spherical curvature matching with the convex spherical surface of the ring 8. The pistons are retained against the surface of the ring 8 by means of anchor members 17 which are hook-shaped and engage the flange-like foot 16 of each piston 11. The anchors 17 are resiliently held against the foot 16 by means of springs 18 fixed to the sides of the ring 8.

The fluid distributor can be of different types. In FIGS. 1 to 4, there is shown a central cylindrical distributor with which the ring 8 acts as a distribution ring to the piston and cylinder arrangements and is associated with a planar rotating joint in a radial plane. This system includes a stepped piston 19 coaxially arranged with the shaft 2 and sitting in a similar stepped cavity provided in the cover 6 with which it can slide in an axial direction but which is prevented from rotating by means not shown.

Each of the chambers 20*a* and 20*b* defined by the stepped piston 19 and the cover 6 communicates with a respective inlet port 6*a* and outlet port 6*b* of the motor. The chambers are sealed by means of seal 21 and 22.

The stepped piston 19 includes a central bore 23*a* communicating with the chamber 20*a* formed in the cover 6, and a plurality of bores 23*b* spaced from, but concentric with, the bore 23*a*. The smaller bores 23*b* communicate the larger annular chamber 20*b* with an annular groove 24 concentric with the central bore 23*a* and defined in the end face of the stepped piston 19. The stepped piston 19 is axially urged against the end of the shaft 2. The pressure applied on the stepped piston 19 is provided by a spring 25 located in the smaller chamber 20*a* of the cover 6.

The shaft 2 defines an axial bore communicating with the bore 23*a* of the stepped piston 19 and also includes individual bores 26*b* spaced from and concentric with the bore 26*a*. The bores 26*b* communicate with the annular groove 24 in the stepped piston 19.

The bores 26*a* and 26*b* extend internally of the shaft and communicate with conduits 27*a* and 27*b* defined in a radial plane and separated from each other by the commutating zones 27*c*.

Figure 3:
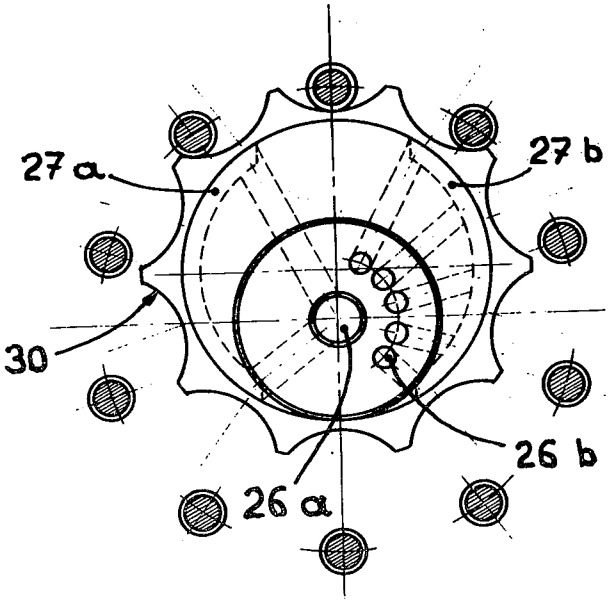
FIG. 3 is a fragmentary schematic cross-section taken along the line B—B of FIG. 1.

The annular ring 8 provides radial bores 28 each communicating with the bore of the tubular piston 11. The bores 28 are provided to communicate the piston and cylinders successively with one or other of the conduit grooves 27*a* and 27*b* respectively, while the eccentric 7 is rotated with the shaft 2. The movement of the ring 8 is controlled by connecting members 29 fixed to the cover 6. The ring, therefore, follows the eccentric movement of the eccentric and is journaled on the rotating eccentric but does not rotate relative to the housing. For instance, as shown in FIG. 3, the connecting members are in the form of pins 29 located on the cover 6 spaced apart and concentric with the axis of the shaft 2. The ring 8 has peripherally spaced notches which individually engage respective pins 29 by controlling the movement of the ring relative to the eccentric 7 and ensures the circular locus of the ring 8 as the shaft 2 is rotating. Finally, the housing is provided with mounting brackets 31, between the cylinders 9, for mounting the motor on its support.

In operation, as a hydraulic motor, the fluid under pressure is introduced through the inlet port 6*a* of the cover 6. The fluid passes through the chamber 20*a*, the bore 23*a* of the stepped piston 19, the axially extending bores 26*a* in the shaft 2, and passes through the conduits 27*a* as well as the groove 27*a*. The groove 27*a* moves such that it is successively in communication with succeeding bores 28. The respective bores 28 in the ring 8 communicate the groove 27*a* momentarily the piston 11 and cylinder 10 arrangements when the groove 27*a* is in the position therewith, to press the piston 11 against the ring and, therefore, the eccentric 7 to cause the rotation of the shaft 2. The groove 27*b* is in similar successive communication with the bores 28 communicating with respective pistons 11. The fluid is exhausted through the conduits 27*b*, separate bores 26*b*, the annular groove 24, the bores 23*b*, the large chamber 20*b* and outlet port 6*b*.

Since the machine is reversible, it is evident that the fluid can be under pressure through the port 6b and is exhausted through the port 6a. The internal circuit followed by the fluid is, of course, reversed from that which has just been described. The rotation of the shaft is inversed with respect to the present case. The hydraulic machine which is the subject of the present invention can, therefore, serve as a reversible motor.

Also, it can be seen that if the splined end 5 of the shaft 2 is connected to a suitable motor means, the hydraulic machine can be used as a pump, in which case the fluid will be pumped through the distribution system in the direction through the ports 6a and 6b corresponding to the direction of rotation of the shaft 2. Accordingly, the hydraulic machine which is the subject of the present invention can be used as a reversible hydraulic pump.

In the preceding description, a general idea is given of the operation of the reversible motor or pump according to the embodiment of FIGS. 1 to 4. One must understand, however, in more detail the features provided by the rotating planar interface joint, including the stepped piston 19 in the stepped cavity of the cover 6 in association with the shaft 2. This rotating interface joint permits the continuity of the fluid circulation in the interior of the machine from its inlet port 6a (or 6b) until its outlet port 6b (or 6a).

Of particular importance is the sealing capabilities of such a planar interface joint eliminating the need of mechanical sealing joints at the interface of the stepped piston 19 and the shaft 2.

As a matter of fact, it is only necessary to determine the radial dimensions of the chambers 20a and 20b in the cover 6 and the radial dimensions of the stepped piston 19 such that the resultant pressure of the fluid in these chambers acting against the stepped piston 19 against the shaft 2 is balanced or overcompensates for the pressure field established at the interface of the stepped piston 19 and the shaft 2.

In the case of an exact equilibrium of the forces, the piston 19 is held against the shaft 2 by means of the spring 25 in the small chamber 20a of the cover 6.

In the case of an overcompensation of these pressures, the spring 25 would be useful when the machine is inoperative to assure the proper functioning of the interfaced joint when the machine is started. In this embodiment, the force applied axially against the shaft 2 is absorbed by the bearing 3a.

In the present embodiment of FIG. 1, the bearing 3a comprises conical roller bearings. It is, of course, obvious that this is not the only manner in which the shaft can be supported and compensating for the resultant forces of the stepped piston 19 axially pressing against the shaft 2 and that such other systems can be used of an axial mechanical or hydrostatic type.

We will now refer in more detail to the cylinder 10, piston 11, and the retaining seats 12, 13 and the spring 14.

In the present state of the art, hydraulic machines including oscillating cylinders, have different degrees of inefficiencies caused by poor static or dynamic equilibrium of the oscillating cylinder, an insufficient compensation of the pressure force, etc. The result is that the transmittable power of such machines is inherently limited if it is necessary to avoid rapid wear. One must, therefore, limit the speed of maximum rotation or limit the maximum pressure or more generally obtain a limitation of the transmittable power.

In accordance with the embodiment of the present invention as shown in FIGS. 1 and 2, the cylinder 10 has a spherical outer surface which fits in the concave spherical curve of the abutment 12 which provides a seat for the spherical cylinder 10. A retaining ring 13 having an interior concave spherical surface acts as a crown on the cylinder 10. The retaining ring 13 could also have a conical surface which would theoretically limit the contact area of the seat with the spherical cylinder 10 to a circular line. The abutment 12 and the retaining ring 13 define between them within the cavity 9, an annular chamber 32, called a decompression chamber, in which the internal wall is the outer spherical surface of the cylinder 10.

The abutment 12 includes, on the spherical concave part serving as a seat for the cylinder 10, an annular groove and along a generatrix of its periphery, a flattened portion 34 communicating the decompression chamber 32 with an annular space 35 at the base of the abutment 12, and with the interior of the housing 1 by means of the bore 36 shown in FIG. 2.

The retaining ring 13 is in the form of an internally stepped piston. The retaining ring 13 is set internally by the cover 15, which is machined accordingly, and is mounted with tolerance in the radial cavity 9 of the housing 1. The retaining ring 13 includes at least an axial bore 37 communicating the decompression chamber 32 with the chamber in which the annular spring 14 is placed above the retaining ring 13.

An O-ring provides a seal between the internal projection of the cover 15 and the retaining ring 13.

The annular groove 33 of the abutment 12 is fed with fluid by means of a radial bore 38 provided in the wall of the cylinder 10. This radial bore 38 communicates with the annular groove 33 at one end and with an annular groove 39 defined in the internal cylindrical bore of the cylinder 10.

Since the groove 39 is at a lower portion of the cylinder 10, the fluid pressure in the groove 39 is appreciably inferior to the pressure generally in the cylinder 10. The annular groove 33 in the abutment is, therefore, fed by a fluid pressure which is lower than the internal fluid pressure in the circulation system of the machine, thereby reducing the chance of leakage. On the other hand, in the light of this lower pressure, with reference to the axial position of the groove 39 in the bore of the cylinder 10 and a value of the tolerance existing between the piston 11 and the bore of the cylinder 10 which serves as a guide for the piston, the abutment seat, in addition to its support role, acts as a damper. Accordingly, a hydrostatic seat is provided.

Furthermore, in view of the geometry of the abutment 12 on the one hand, depending on the dimensions of the annular groove 33 and the lateral support zone of the cylinder 10, with the retaining ring 13 on the other hand, the cylinder 10 is essentially in a hydrostatic equilibrium between the two parts 12 and 13.

In other words, the sizing of the abutment 12 is such that its hydrostatic lift equilibrates approximately the pressure field delimited exteriorly by the valve seat 13 pressing the cylinder 10 against the abutment 12.

According to the embodiment of FIGS. 1 and 2, the retaining ring 13 is itself hydrostatically equilibrated or slightly undercompensated. This is defined by choosing its diameter contacting the guiding projection of the cover 15 with respect to the contact on the cylinder 10. In the case of hydrostatic equilibrium of the forces, the maintenance of the contact of the retaining ring 13 on the cylinder 10 is provided by the spring 14.

In the case of an overcompensation of the forces in the direction of application of the retaining ring 13 on the cylinder 10, the spring 14 should still be retained such that it maintains a contact between those parts when the hydraulic machine is inoperative.

According to the preceding embodiment, therefore, the following advantages are obtained:

Static equilibrium of the cylinder about its center of rotation which coincides with its center of gravity. The balance of the oscillation allows the increase of the frequency of oscillation and, therefore, the velocity of rotation of the hydraulic machine without risk of excessive friction between the cylinder and piston and without risk of deterioration of the parts during movement, and that without interfering with the performances thereof at low speeds. It is, therefore, possible to utilize the hydraulic machine of the present invention as a low speed high torque motor, or as a motor which is of moderate speeds with higher specific power.

Hydrostatic equilibrium of the cylinder between the abutment and the retaining ring and total hydrostatic compensation of the loads by of the abutment regardless of the pressure of the fluid in the internal circulation of the machine. The machine can, therefore, be worked under very high pressure, without risk of deterioration, and maintaining its high output over a longer period of time and with a good efficiency.

The damping feature of the abutment against the excessive sudden pressure such that the machine is insensitive to pulsating pressure and resistant to shock.

Feeding of the fluid through the machine by means of a rotating interface planar joint eliminates mechanical conventional joints which always include high wear parts.

Furthermore, in view of the construction of the machine, with hydrostatic compensation of the forces at all levels, the hydraulic machine of the present invention can undergo simultaneous pressures at both inlet and outlet ports. This feature permits the broadening of the field of utilization of the machine, and particularly the machine being a motor, can be used for synchronization of jacks.

In such an application, at least two of these machines are connected mechanically so that they turn at the same speed or through a mechanical reduction such that they turn at a predetermined speed, and the fluid is supplied from the same source such that each machine gets a fraction of the total fluid proportional to its speed of rotation.

The result is that the two ports of each machine are essentially under the same pressure which may be the relief pressure of the circuit the difference between the supply pressure and the exhaust being essentially the mechanical losses of the machine. The machine can also be used as a motor in a closed circuit controlled by a servo valve.

Actually, in the present state of the art, servo valves generally have a principal level including a slide valve of which the neutral position connects the outlet ports of the valve to the inlet port communicating with the source of pressure. The result is that the motor, which is situated downstream of the valve, must support the relief pressure of the circuit at both of its ports which, with conventional machines, is not permissible. The motor can also be arranged in a hydraulic series, and in this case, the motor which is situated upstream must be able to support the relief pressure of the circuit on its inlet port, and simultaneously at its outlet port must support an intermediate pressure between the high and low pressures of the circuit in relation to the mechanical energy at each of the motors in the hydraulic series.

It is quite evident that, in the case of hydraulic machines normally operating at low power or medium power, one can advantageously replace the hydrostatic abutment serving as a seat for the cylinder as previously described by a simple axial ball socket on which the surface would have been treated or provided with a coating in the area of support of the cylinder so as to reduce the coefficient of friction and to avoid jamming. In such a case, the retaining ring 13 would simply act to limit the field of pressure acting on the top of the cylinder 10 and, therefore, limit the pressure of contact of the cylinder 10 on the abutment 12.

Other embodiments could, of course, be made. In one embodiment, the retaining ring 13 could be made to act as a safety valve. For example, one can visualize a bore or a conduit (not illustrated) to communicate the decompression chamber 32 with the interior of the housing 1. The spring 14 would still be maintained so that an overpressure in the bore defined by the cylinder and piston would put the retaining ring 13 in an unbalanced situation and push it against the spring 14 so as to allow a momentary leakage of the fluid towards the decompression chamber 32 and through to the interior of the housing, reducing therefore the super-pressure.

FIGS. 5 to 11 show other variants. In the longitudinal cross-section of FIG. 5, the overall arrangement of the hydraulic machine 1 can be found with the following variations:

(a) First of all, the cylinder 10 has an outer surface made up of two semi-spheres of different radii. The centers of these two spheres would, however, coincide with the center of rotation of the part. In spite of the fact that there is an imbalance of the masses, such an embodiment would have the advantage of bringing the retaining ring 13 closer to the abutment 12 so as to permit a reduction of the radial dimension of the machine.

(b) The piston is retained in contact with the ring 8 by means of a compression spring 40 which abuts against the shoulder defined in the bore of the piston 11 and against a cap 41 mounted on the end of a tie rod 42 fixed to the ring 8 by any known means and, for example, by a wire 42 of sufficient size forming a loop engaged around a pin 43 fixed within the ring 8 and subtending the passage 28 as well as the pin being parallel to the axis of the shaft 2.

This arrangement provides two principal advantages. First of all, the force of the spring 40 on the piston 11 is practically always constant, no matter what the position of the piston with respect to the cylinder 10 is. In other words, the spring can be selected such that it has a value sufficient to maintain the contact of the piston 11 on the ring 8. However, when the machine is in operation, the spring is not used dynamically and, therefore, very little fatigue is absorbed by the spring or is at least negligible.

In this manner, one of the main problems of hydraulic machines is eliminated. On such conventional machines, the compression spring, which normally engages the bottom of the cylinder or the cover, is subject to a deflection equal to the travel of the piston. It is, therefore, necessary to strongly calibrate the spring so that its resistance to fatigue is sufficient. However, its load at maximum deflection can be quite high which causes friction at the foot of the piston. It is well known that such springs remain the weak point in hydraulic machines, and the reliability of the machine is inversely proportional to the number of cylinders.

Figure 5:
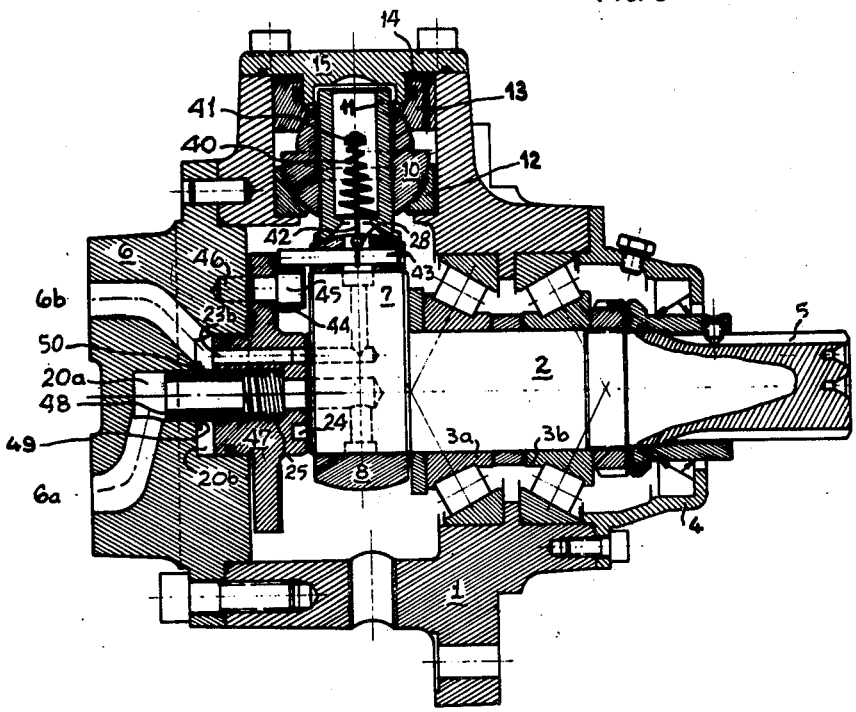
FIG. 5 is an axial cross-section, similar to FIG. 1, but showing a different embodiment thereof.

According to the embodiment previously described, that is, with respect to FIG. 5, it is noted that the spring is almost static and is, therefore, subject to the minimum of fatigue, and the chances of a premature breakage or decrease in the tension of the spring are reduced. A hydraulic machine equipped with springs of the type described herein is, therefore, able to work at a much higher speed.

Figure 6:
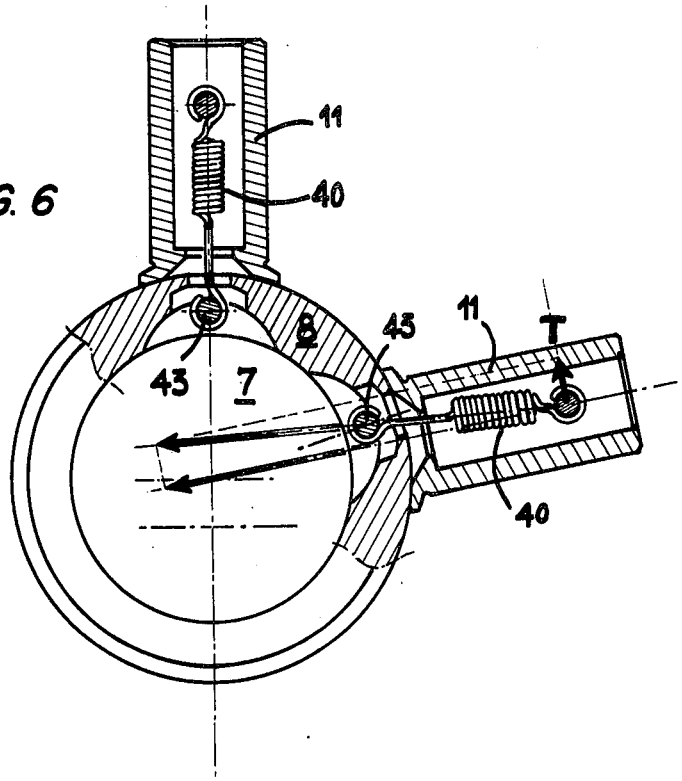
FIG. 6 is a fragmentary schematic cross-sectional view taken through a detail of the embodiment of FIG. 5 but with slight modifications thereof.

It should be kept in mind also that given a proper attachment means, it is possible to replace the compression spring 40 by a traction spring of the type shown schematically in FIG. 6.

The other advantage of the apparatus shown in FIG. 6 is that, as the piston 11 is displaced angularly from its dead center, the spring 40 will urge it back to its dead center by imposing a resultant force T perpendicular to the axis of the piston.

The amplitude of the resultant force is a function of the location of the anchoring of the spring within the piston, the location of the head 41 within the bore defined in the piston 11. Therefore, one can adjust the location of this anchor according to the specific needs.

This feature is an assurance against the phenomenon of the lifting of the foot of the piston relative to the ring 8 which can be encountered in the conventional systems above a certain speed of rotation.

The inclusion of the piston anchoring system herein described therefore increases the possibility of high rates of rotation of the hydraulic machine without the risk of the lifting of the foot of the piston and, therefore, with a minimum risk of leakage between the piston and the ring 8.

Referring further to the differences between the embodiment of FIG. 5 and FIG. 1, the planar rotating joint includes two pistons 47 and 48. Piston 48 slides within a central bore of piston 47 in which it compresses the spring 25. Spring 25 has the same role as in FIG. 1. The piston 48 has limited axial movement limited by the annular ring 50 held by the clip 49. The annular ring 50 abuts against the wall of the chamber **20*b*. The rotating joint, in accordance with FIG. 5, is believed to be more flexible than a monoblock stepped piston 19 of the embodiment shown in FIG. 1. The play between the parts is such that the piston 47 always has a good support pressure against the end of the shaft 2** so as to improve the sealing capabilities at the interface.

The piston 47 has a collar in which cylindrical pins 45 are mounted and extend parallel to the axis of the shaft. The pins 45 mount abutment rings 44. Also, the pins 43 extend beyond the margins of the ring 8 and are adapted to engage the abutment rings 44. The dimensions of the pins 43 and the abutment rings 44 as well as their relative spacing is a function of the eccentric center distance from the axis of the shaft.

In the embodiment shown in FIG. 5, there are as many pins 43 as there are cylinders, and each pin 43 has a corresponding pin 45 and abutment ring 44.

Figure 7:
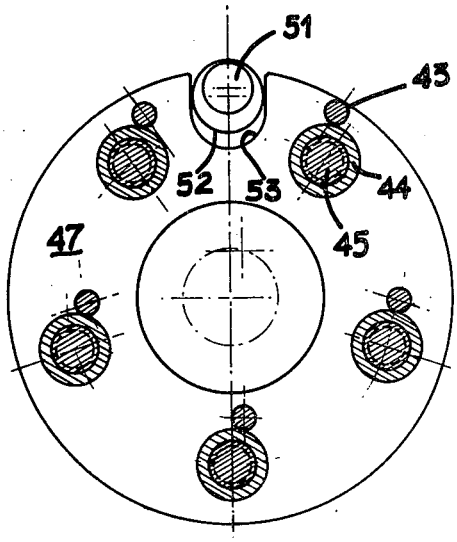
FIG. 7 is a fragmentary radial cross-section showing a further detail of the embodiment of FIG. 5.

FIG. 7 shows an axial view of this system which is meant to replace the pin and notch system of FIG. 3.

During the operation of the machine, each abutment ring is adapted to roll on the corresponding pin 43 which permits the circular translation movement of the ring 8 in relation to the rotation of the shaft 2.

The piston 47 is prevented from rotational movement by any means and which is represented in the embodiment of FIG. 5 by a lug 46 provided in the collar supporting the pin 45. The lug 46 engages a suitable aperture in the cover 6 with suitable play so as not to interfere with the axial sliding movement of the piston 47.

In certain situations, it would be useful to have access to the cottering of the distributor parts once the machine is completely assembled if only to be able to make a minor adjustment to compensate for different machining tolerances during the manufacture of the machine. In such a case, the pin 46 can be replaced by the system shown schematically in FIG. 7 which includes an eccentric 51 which traverses the cover 6 in such a way that it is accessible from the exterior of the machine, and which the eccentric part 52 engages in a notch 53 provided on the periphery of the collar on piston 47. By pivoting the axis of the eccentric from the exterior of the machine, one can control the angular displacement of piston 47, thus effecting an angular displacement of the ring 8 relative to the eccentric 7 on the shaft 2 by the intermediary of pins 45, of abutment rings 44 and abutting pins 43.

Accordingly, by this method, the cottering of the distribution system can be refined or improved depending on the operating conditions of the particular machine and its normal rate of rotation. For instance, one can adjust for maximum cottering and have a good cyclical regularity at low speed in one direction of rotation. On the other hand, if one wishes to have a perfectly reversible machine, it is best to arrange the distributor parts so that they are perfectly symmetrical, and this can be done by the above-mentioned adjustments.

Accordingly, it is not necessary to readjust the distributor itself which only the manufacturer can do, but the user can make any necessary adjustments himself to adapt the hydraulic machine to its specific use.

FIGS. 8, 9, 10 and 11 illustrate schematically other systems for maintaining the ring 8 in its proper position for circular translation movement. It is understood, however, that the description of the embodiments is not inherently limiting since many other different methods could be contemplated.

Figure 8:
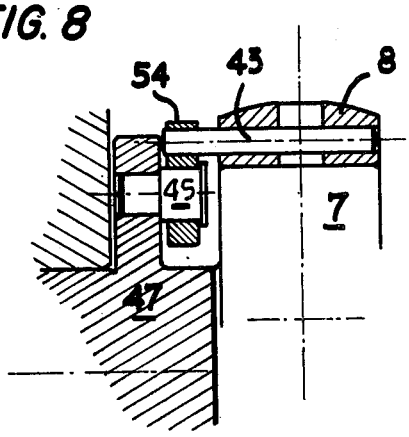
FIG. 8 is a fragmentary axial cross-section of the embodiment of FIG. 5.

According to FIG. 8, a large thick wheel 54 having two parallel apertures is provided such that the pin 45 fits in one of the apertures while the pin 43 is seated in the other aperture. This solution is an improvement over that shown in FIG. 5 since the distribution of forces on contact is better, between the different parts.

Figure 9:
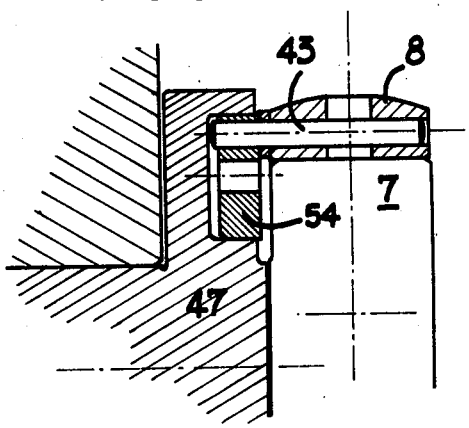
FIG. 9 is a similar fragmentary axial cross-section of FIG. 8, but showing another embodiment thereof.

Looking now at FIG. 9, the pin 45 is completely replaced and the equivalent of a cavity defined in the collar of the piston 47 is provided and receives the wheel 54 which rotates about its main axis, and pin 43 still passes through the aperture therein.

Figure 10:
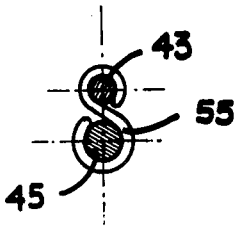
FIG. 10 is a radial cross-section of yet a further embodiment of the details shown in FIGS. 8 and 9.
Figure 11:
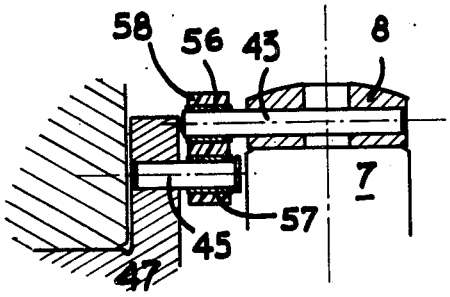
FIG. 11 is a fragmentary axial cross-section of FIGS. 8 and 9 and showing yet a different embodiment thereof.

Referring to FIGS. 10 and 11, there are shown two different elastic connecting members between the pin 43 and pin 45. These arrangements have the advantage that they can better absorb and tolerate different distances between the axes of pin 43 and pin 45.

The system in accordance with FIG. 10 is simply an "S"-shaped torsion spring 55 in which the loops engage respectively pins 43 and 45.

The system shown in FIG. 11 includes separate metallic sleeves 56 and 57 about which is molded an elastic 58 of the elastomeric or plastic type. The pin 43 and pin 45 fit in the respective sleeves.

It is evident that one can combine these systems of FIGS. 10 and 11 and, for example, replace the elastic support of FIG. 11 by a metallic spring of FIG. 10 or by a traction spring. One can also, by choosing the right type of plastic material, eliminate the metallic sleeve of FIG. 11 and provide the apertures for the pins 43 and 45 directly into the material of the connecting member 58 which means essentially making the wheel 54 of FIG. 8 with plastics material.

In the preceding description, the machine has been provided with a central cylindrical distributor, with a ring 8 intermediate the eccentric 7 and the pistons 11 serving also as a distributor ring.

Following the embodiment shown in FIGS. 12 and 13, the feeding of the hydraulic machine is provided by a planar distributor of a different concept, of which the advantages will be made evident in the following description.

Figure 12:
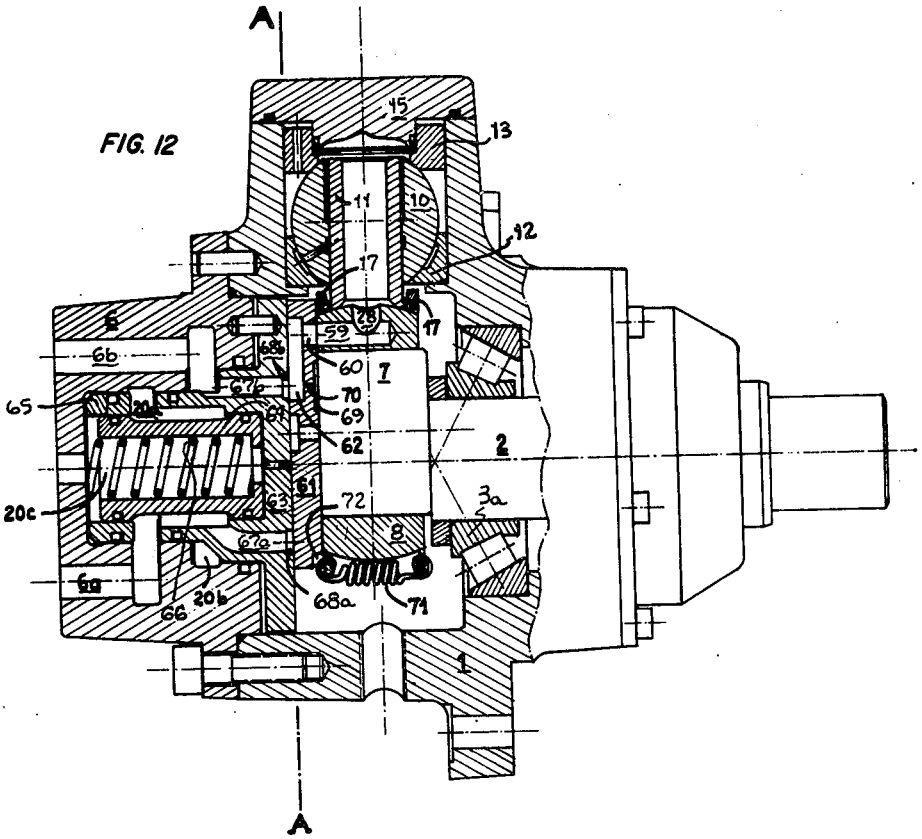
FIG. 12 is an axial cross-section of still another embodiment of the present invention.

FIG. 12 shows essentially the arrangement of the embodiment in FIGS. 1 to 5 with certain differences, however.

For one thing, the radial passages 28 in the ring 8 are now extended by a bore 59 which is parallel to the axis of the ring, and which communicates with a bore 60 defined in the plate 61 fixed to the ring 8. The plate 61 is generally in a radial plane. Each bore 60 communicates with a slot 62 defined in the plate 61, and opening on the outer surface of the plate 61. These slots 62 extend in a radial direction and number five, that is, one for each cylinder in this machine. Each of the slots 62 is spaced an equal distance from each other and at the same distance from the center of the plate 61 which coincides with the center of the ring 8.

The plate 61 which has an outer surface in a radial plane is adapted to slidingly engage the end surface also in a radial plane of a stepped piston 63 called a stator, and located essentially along the axis of the shaft 2 of the machine in a stepped cavity defined in the cover 6 adapted for axial sliding movement but held against rotational movement.

A pushing member 64 slides in a cavity provided centrally along the axis of the stator 63 within the cover 6. The push member 64, along with the stator 63 and a sleeve 65, define chambers **20*a*, 20*b* and 20*c***, each sealed one from the other by various O-ring seal devices.

The chambers **20*a* and 20*b* are in communication with respective ports 6*a* and 6*b*. The chamber 20*c* is in communication with the interior of the housing 1 of the machine by the intermediary of suitable passages. Internally of the chamber 20*c*, a coil spring 66 ensures the necessary pressure of the push member 64 against the stator 63 and, therefore, the sealing pressure of the stator 63 against the outer face of the plate 61**.

The stator 63 comprises passages **67*a* and 67*b* communicating respectively with chambers 20*a* and 20*b* to the openings 68*a* and 68*b* defined in the radial planar face of the stator 63**.

Figure 13:
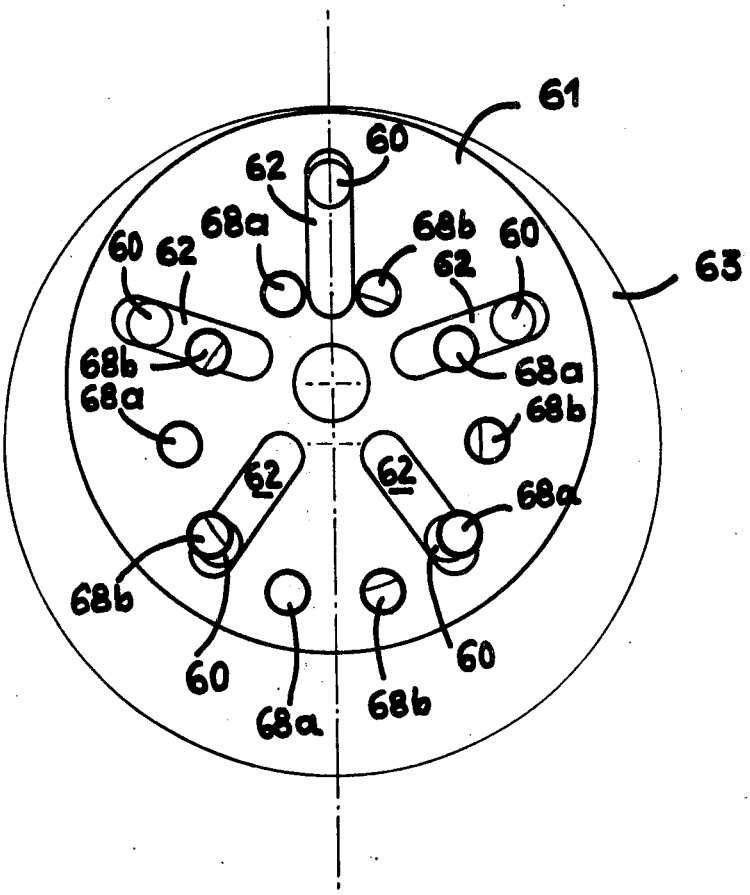
FIG. 13 is a schematic view in a radial plane of the location of details of the embodiment shown in FIG. 12 to the right of line A—A therein.

According to the present embodiment as shown in FIGS. 12 and 13, these openings, represented by the numbers **68*a* and 68*b*, total ten, that is, twice as many as the slots 62. All of the openings 68*a* and 68*b* are concentrically located about the axis of the stator 63 which is essentially the axis of the shaft 2 of the machine. All of the openings 68*a* and 68*b* are equidistant and are alternated such that every opening 68*a* is spaced by an opening 68*b***.

Finally, as shaft 2 rotates, the ring 8 and the plate 61 which is fixed thereto are journaled on the eccentric 7 and follow a circular locus, although the ring 8 and the plate 61 do not rotate relative to the housing, but have a circular translation movement whose amplitude is relative to the distance travelled by the pistons 11. Means to maintain the ring 8 and plate 61 assembly in a circular translation movement, which are not represented on the FIGS. 12 and 13, may be of any type previously described.

During the circular translation movement of the ring 8 and plate 61 relative to the stator 63, each of the slots 62 coincides alternatively with openings **68*a* and 68*b* which allows for the alternative communication of each cylinder 10 and piston 11 arrangement with the feed and exhaust ports 6*a* and 6*b* of the collector 6 as is clearly shown in FIGS. 12 and 13**.

Accordingly, a planar distribution has been obtained in which the two parts of the distributor have a relative circular translation movement.

The radial dimensions of the chambers **20*a* and 20*b* are determined by the pressure force acting on the stator 63 against the plate 61 to compensate exactly or to overcompensate the resultant force of the pressure field at the interface of the stator 63 and the plate 61**.

In the case where an equal or exact compensation of the forces is obtained, the maintenance of the contact of the stator 63 against the external face of the plate 61 is ensured by the spring 66.

In the case of an overcompensation of these forces, the spring 66 can still be useful in order to ensure a contact between the stator 63 and the plate 61 when the hydraulic machine is inoperative.

In order to set up a hydrostatic system about the plate 61, an aperture 70 which is properly calibrated is adapted to communicate with a rear chamber 69 to allow some of this fluid to leak into this chamber. In such a planar distributor, the balance of the axial loads, which tend to push the plate 61 against the radial end face of the eccentric 7, may be obtained, as represented on FIG. 12, with a particular hydrostatic pad, disposed on the rear face of the plate 61. As represented, a rear chamber 69 has been disposed behind each slot 62 and communicates with through a properly calibrated aperture 70.

As the eccentric 7 rotates relative to the ring 8 and the plate 61, the interior face of the plate 61 presses against the radial end surface of the eccentric 7 and a field of pressure can be established between these two surfaces as the machine is functioning with this new field of pressure being in equilibrium with the field of pressure established at the interface between the plate 61 and the stator 63 and permitting relative rotation of the planar faces between the plate 61 and the end of the eccentric 7. The axial forces applied against the eccentric 7 and the shaft 2 are absorbed by the bearing **3*a*** which has been selected accordingly.

The type of distributor described, that is, a planar distributor with relative rotational movement of translation between the parts has the following advantages. During the circular translation movement of the ring and the plate, the relative speeds of the opposite faces are everywhere equal. There is, therefore, no risk of uneven wear in one area compared to another, but on the contrary, there is a constant even wear which provides for longevity and proper functioning of the distribution system. Since the relative speeds between the parts are low, the heat generation is also kept low and the wear is kept at a minimum. A good hydrostatic equilibrium is obtained between the parts of the distributor for reducing any tendency to buckle one relative to the other. Again, this reduces the risk of local uneven wear in one area as opposed to the other, and a sealing is guaranteed no matter what the speed or the pressures of operation are in the machine. All of these advantages allow the machine to be operated at higher specific power than conventional machines, that is, higher speeds and higher pressures, without reducing the life of the machine or without interfering with the regularity of rotation when rotating at a low speed.

It is obvious that the embodiment described with respect to FIGS. 12 and 13 is only given as an example and is not limiting. For instance, the planar distributor having a circular translation movement could be associated with machines having different designs than that described here.

To complete the description of the embodiment shown in FIG. 12, it is noted that the shoes of the piston are retained in contact against the ring 8 by means of a pair of anchors 17 similar to that described with respect to FIG. 1, in which the anchors are urged to resiliently hold the shoes of the piston by means of traction springs 71 which connect the anchors.

The springs 71 are disposed circumferentially between the cylinders, and to avoid that the springs abut against the piston during the rotation of the machine, at least one of the anchors 17 is fixed against rotation relative to the ring 8. For instance, in FIG. 12, in the periphery of the plate 61, there is a radial notch 72 in which the loop of the spring 71 can be engaged. The size of these notches corresponds to the diameter of the wire used in fabricating the spring.

I claim:

1. A hydraulic machine comprising a plurality of radially extending pistons in a housing, a shaft mounting an eccentric in the housing, means connecting the pistons radially with the eccentric, each piston being mounted for sliding movement within a mobile cylinder, the cylinder havng a spherical outer surface and being retained between a pair of retaining rings, the first retaining ring having a concave spherical surface matching with the spherical surface of the outer surface of the cylinder, means for providing fluid under pressure in an annular sealed zone between the cylinder and the first retaining ring, whereby the first ring functions as a hydrostatic pad for the cylinder, the second retaining ring in the form of a valve seat which is hydrostatically balanced and thus limits the field of pressure which can be established above the cylinder, spring means urging the second ring in contact against the spherical surface of the cylinder, the cylinder thus having an oscillating movement subject to the relative rotation of the shaft relative to the housing, the cylinder being in hydrostatic equilibrium at all positions of its oscillation between the first and second retaining rings, the said cylinders being placed in communication successively with feed means and exhaust means.

2. An apparatus as defined in claim 1, wherein the outer surface of the cylinder is generated by two semi-spheres of different radius but having coinciding centers, such that the spherical surface in contact wit the first retaining ring is different from the spherical surface in contact with the valve seat which has a conical shape.

3. A hydraulic machine having a housing, a shaft rotatably journaled in the housing, radial pistons slidably mounted in the housing, the shaft mounting an eccentric, and means to retain the pistons against the eccentric as the eccentric rotates in the housing, the means for retaining the pistons against the eccentric including a ring journaled on the eccentric to which the pistons are anchored, each piston adapted to slide in the interior of the cylinder mounted in the housing, a distributor in the housing, means in the ring communicating the individual pistons with the distributor, connecting means between the housing and the ring to retain the ring against rotational movement relative to the housing, and thereby to provide a circular translation movement to the ring as the eccentric rotates within the housing such that the circulation of fluid from the distributor through the eccentric, the ring and the pistons is uninterrupted throughout the complete cycle of the eccentric, the distributor including a stepped piston adapted to slide axially in the housing and having a planar face adapted to slidingly engage the end of the eccentric in a radial planar interface, the stepped piston being held against rotational movement.

4. An apparatus as defined in claim 3, wherein an adjustment of the distribution can be effected from the exterior of the machine by means of an eccentric control journaled in the housing having an axis parallel to the axis of the shaft, the eccentric portion of the control adapted to engage a notch provided in a collar in the stepped piston such that rotational movement of the control from the exterior of the housing will cause a slight adjustment of the relative position of the stepped piston relative to the eccentric on the shaft of the machine.

5. A fluid machine, with a high specific power, comprising a housing, a shaft rotatably journaled in the housing and mounting an eccentric cam receiving a ring slidingly engaged thereon, a plurality of radial tubular pistons extending from the ring, each piston being mounted for sliding movement within a cylinder, each piston oscillating in the housing, a stator, slidingly engaged in the housing, centrally coaxial with the shaft and immobilized in the housing against rotational movement, connecting members between the ring and the stator for preventing the ring from turning with the eccentric cam and effecting a circular translation movement to the ring as the shaft rotates relatively to the housing, means for allowing a continuous flow of fluid through the machine from an inlet port, through the cylinder-piston assemblies, to an outlet port, distributor means including two main parts in association with the circular translation movement of the ring ensures the fluid distribution to the different cylinder-piston assemblies, and adjustment means to affect the fluid distribution from the exterior of the machine comprising an eccentric control journaled in the housing having an axis parallel to the axis of the shaft, the eccentric control adapted to engage a radial notch provided in the stator, such that rotational movement of the control from the exterior of the housing will cause a slight circumferential movement of the ring, through the stator and the said connecting members anchored to the stator, the eccentric control being then used to fix the stator in rotational position once the adjustment has been effected.

6. An apparatus as defined in claim 5, wherein said distributor means includes two main parts, one part being the stator which is adapted to slide axially in the housing and includes a radial planar face, with openings on this face, concentrically located about the axis of the stator, said openings being twice as many as the number of cylinder-piston assemblies and comprising inlet and outlet openings, said inlet openings communicating with the inlet port of the machine, said outlet openings communicating with the outlet port of the machine, said inlet and outlet openings being alternatively arranged such that every said inlet opening is spaced by one said outlet opening, the other main part of the said distributor means being the ring to which is fixed a plate having a radial planar face adapted to slidingly engage the radial planar face of the stator, slots defined in the face, the number of slots being equal to the number of the cylinder-piston assemblies, each slot communicating with one cylinder-piston assembly through the ring, the said openings in the stator and said slots of the ring being arranged such that, when the shaft rotates in the housing, every said slot, during its circular translation movement relative to the stator, coincides alternatively with one said inlet opening and one said outlet opening of the stator, which allows for the alternative communication of the corresponding cylinder-piston assembly with the inlet port and the outlet port of the machine, and maintains the continuity of the fluid flow from the inlet port of the machine to the outlet port.

7. A aparatus as defined in claim 5, having a cylindrical distributor means associated with the controlled relative circular rotation of the eccentric cam and the translation movement of the ring to effect the distribution of fluid to each cylinder-piston assembly, wherein the ring acts as a rotational distributor between the eccentric cam and the cylinder-piston assemblies, and wherein the stator is held against rotation and includes a radial planar face and is the static part of a rotating joint, while the mobile part is constituted by the radial planar face of the end of the shaft, the radial planar faces of the stator and the shaft being slidingly engaged, the said stator and the said shaft having internal conduits sealingly connecting the inlet port of the machine to the inlet port of the distributor means and the outlet port of the distributor means to the outlet port of the machine.

8. An apparatus as defined in claim 5, wherein each oscillating cylinder has a spherical outer surface and a central cylindrical bore in which is slidingly engaged the corresponding piston, is retained between two retaining rings, the first retaining ring having a concave spherical surface fitted for the lower spherical outer surface of the cylinder and acting as a hydrostatic pad for the said cylinder, and a second retaining ring, in the form of a valve seat, hydrostatically balanced, which limits the field of pressure acting above the cylinder, with spring means urging the said second retaining ring in contact against the upper spherical surface of the cylinder, the said cylinder thus having an oscillating movement subject to the rotation of the shaft relative to the two retaining rings in the housing, and being in hydrostatic equilibrium at all positions of its oscillation between the first and the second retaining rings, whatever may be the pressure value and the pressure fluctuations.

9. An apparatus as defined in claim 8, wherein the outer surface of each cylinder is generated by two semispheres of different radius but having coinciding centers, such that the spherical surface fitted for the first retaining ring is different from the spherical surface in contact with the second retaining ring, which has a conical seat.

* * * * *